US007854318B2

(12) United States Patent
Chen

(10) Patent No.: US 7,854,318 B2
(45) Date of Patent: Dec. 21, 2010

(54) TOOL BOX

(75) Inventor: Tai Hung Chen, Chang Hua Hsien (TW)

(73) Assignee: Infar Industrial Co., Ltd., Chang Hua Hsien (TW)

( * ) Notice: Subject to any disclaimer, the term of this patent is extended or adjusted under 35 U.S.C. 154(b) by 0 days.

(21) Appl. No.: 12/412,556

(22) Filed: Mar. 27, 2009

(65) Prior Publication Data

US 2010/0243496 A1 Sep. 30, 2010

(51) Int. Cl.
*B65D 69/00* (2006.01)

(52) U.S. Cl. ..... 206/234; 206/373; 206/379

(58) Field of Classification Search ..... 206/373, 206/234, 216, 223, 372, 349, 472, 486, 490, 206/38, 379
See application file for complete search history.

(56) References Cited

U.S. PATENT DOCUMENTS 5,782,150 A * 7/1998 Huang ..... 81/177.4
5,899,329 A * 5/1999 Hu et al. ..... 206/376
6,076,665 A * 6/2000 Chuang ..... 206/234
6,347,875 B1 * 2/2002 Painsith ..... 362/119
6,460,698 B1 * 10/2002 Wang ..... 206/234
6,840,389 B2 * 1/2005 Chen ..... 211/70.6
7,441,654 B2 * 10/2008 Liu ..... 206/349
2006/0175217 A1 * 8/2006 Hu ..... 206/373

* cited by examiner

*Primary Examiner*—Mickey Yu
*Assistant Examiner*—Jenine M Pagan
(74) *Attorney, Agent, or Firm*—Bacon & Thomas, PLLC

(57) ABSTRACT

A tool box adapted for storing a driving tool therein, the tool box comprises a casing means including a compartment adapted for receiving the driving tool; wherein the compartment further includes a pressing member and a receiving portion below the pressing member and adapted to clamp the driving tool; wherein the pressing member is movable between an original position and an actuating position; wherein while the pressing member is in the actuating position, the driving tool is driven to detach from the casing means.

18 Claims, 10 Drawing Sheets

TOOL BOX

BACKGROUND OF THE INVENTION

1. Field of the Invention

The present invention relates to a tool box.

2. Description of the Related Art

In a known embodiment, a storage device for tool box comprises two housing portions which accommodate the screwdriver bits and the chuck. One of the housing portions defines a cover, so that when storage device is closed, the screwdriver bits and the chuck are removed from sight. It is thus impossible to recognize the nature of the screwdriver bits and the chuck from outside. Such a storage device also turns out to be non-sales-promoting, in particular if the storage device is accommodated in a transparent packaging, even though the storage device can be seen.

SUMMARY OF THE INVENTION

Aspects of the present invention address one or more of the issues mentioned above, thereby providing a tool box that comprises a casing means which consists of first and second casing shells and is adapted for storing a bits seat body and first and second driver adapters. A ratchet wheel unit is disposed on the second casing shell and fixed to the first casing shell. First, second and third through-holes that are formed on the sidewall of the first casing shell, hence, the bits seat body and the first and second driver adapters are exposed from the casing means and the bits seat body and the first and second driver adapters can be pressed to detach from the casing means without taking apart the casing means.

Other objectives, advantages, and features of the invention will become more apparent from the following detailed description when taken in conjunction with the accompanying drawings.

BRIEF DESCRIPTION OF THE DRAWINGS

The present invention will be described via detailed illustration of the preferred embodiment referring to the drawings.

DETAILED DESCRIPTION OF THE PREFERRED EMBODIMENT

Figure 1:
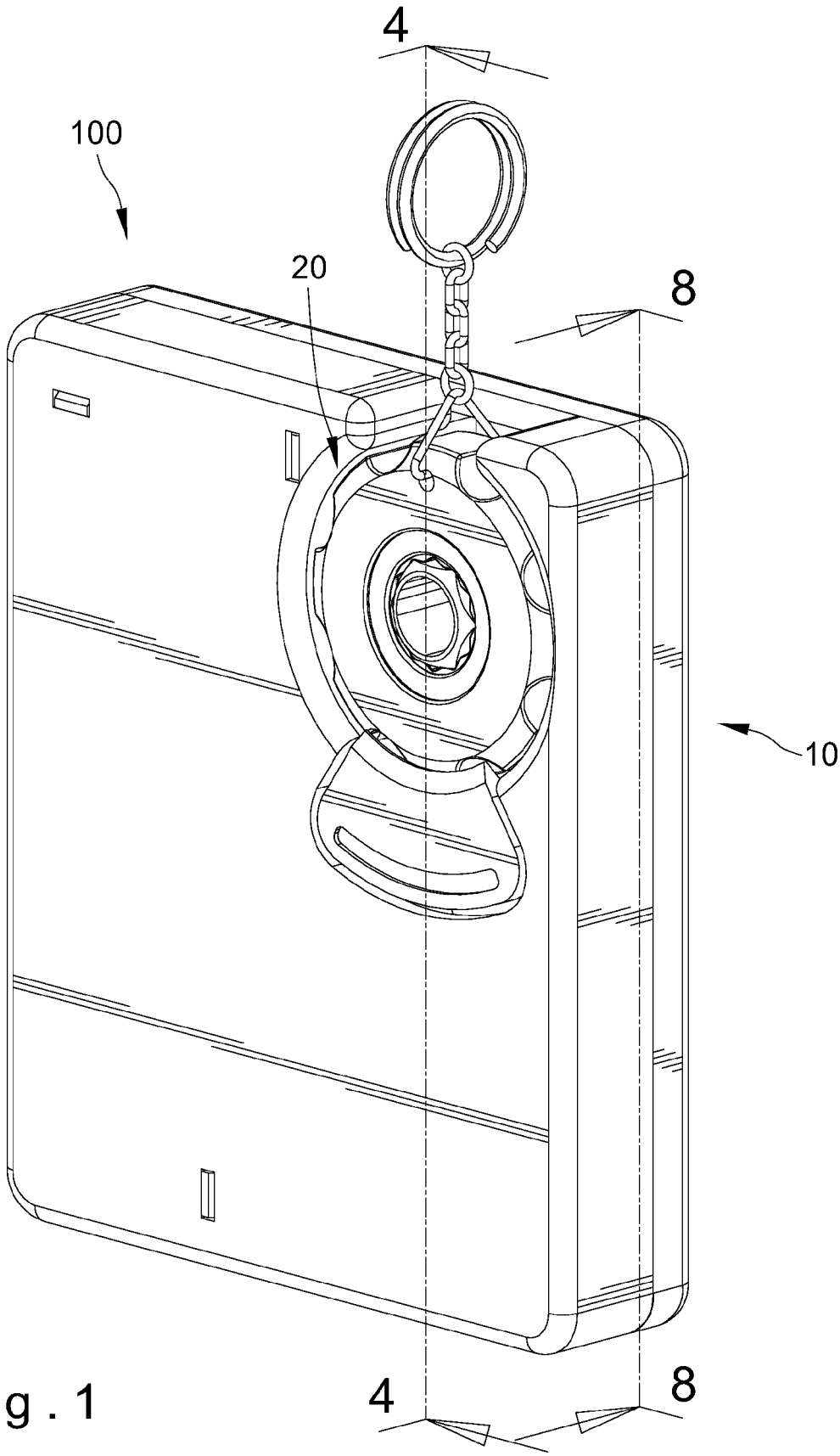
FIG. 1 is a perspective view of a tool box according to the preferred embodiment of the present invention.

With reference to the above figures, they show a tool box 100 in accordance with the preferred embodiment of the present invention. The tool box 100 includes a casing means 10 which consists of first and second casing shells 11, 12, a ratchet wheel unit 20 embedded on the second casing shell 12, a bits seat body 30 for storing various sizes of bits 40 and first and second driving tools 50, 60. The bits seat body 30 and the first and second driving tools 50, 60 are stored in the casing means 10 and sandwiched by the first and second casing shells 11, 12. The first driving tool 50 is in form of quick release adapter of screwdriver and includes a first end 51 used as a mounting end of a tool bit and a second end 52 used as a chuck. And the second end 52 is able to couple to one of the bits 40. The second driving tool 60 includes a first end 61 having a detent 611 and a second end 62 forming a hexagonal recess 621.

The first casing shell 11 which has top and bottom edges 111, 112 includes three lugs 113 projecting from the inner side thereof. The second casing shell 12 which has top and bottom edges 121, 122 includes three coupled holes 123 formed thereon and corresponding to the lugs 113 of the first casing shell 11 as to attach the first and second casing shells 11, 12 to each other. First, second and third compartments 13, 14, 15 are provided in the casing means 10 between the first and second casing shell 11, 12 and parallel to each other. The bits seat body 30 and the first driving tool 50 are respectively clamped in the first and second compartments 13, 14. The third compartment 15 includes a pressing member 151 and a receiving portion 152 below the pressing member 151. The receiving portion 152 is adapted to clamp the second driving tool 60.

Figure 2:
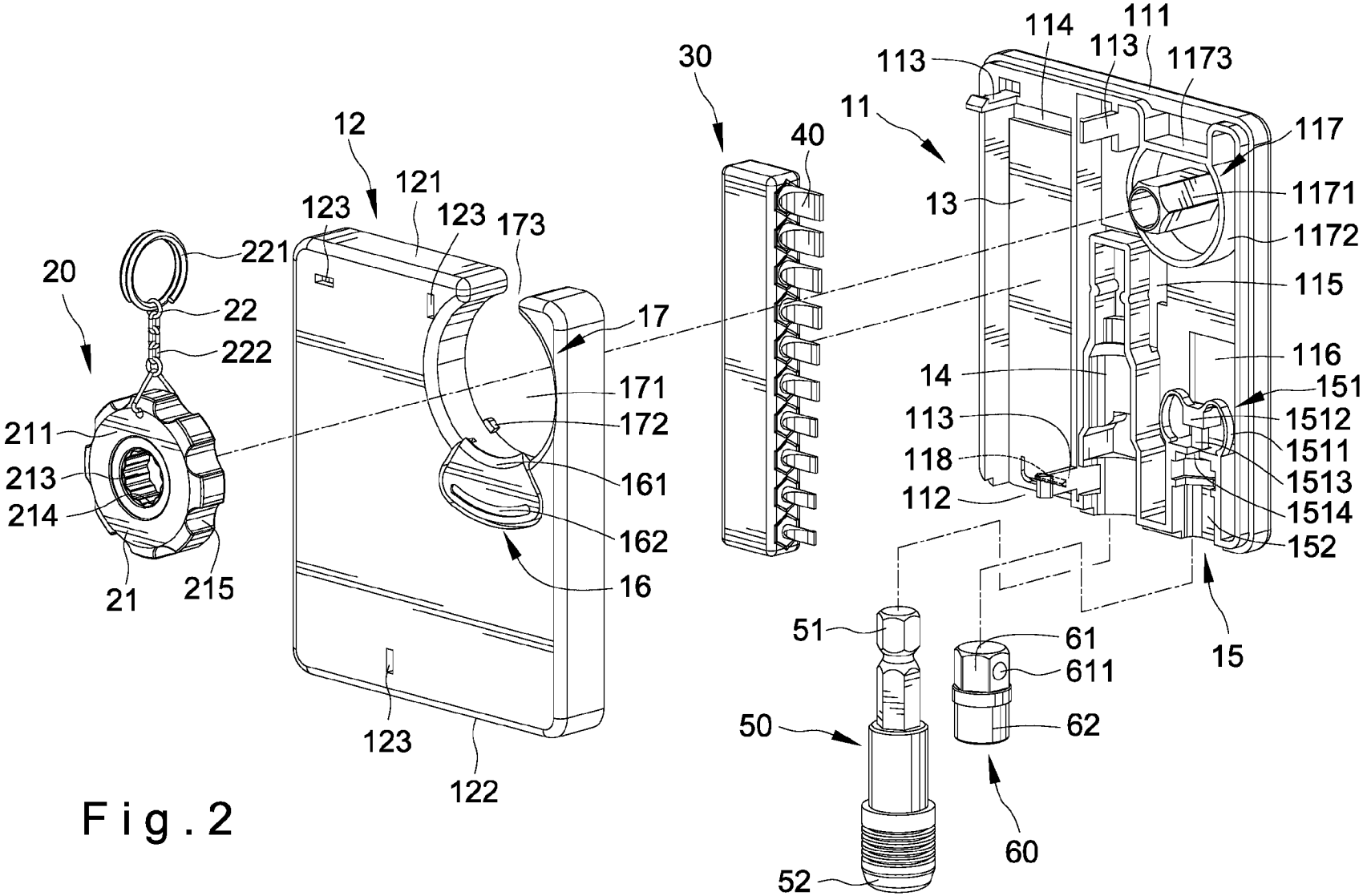
FIG. 2 is an exploded view of the tool box shown in FIG. 1.
Figure 3:
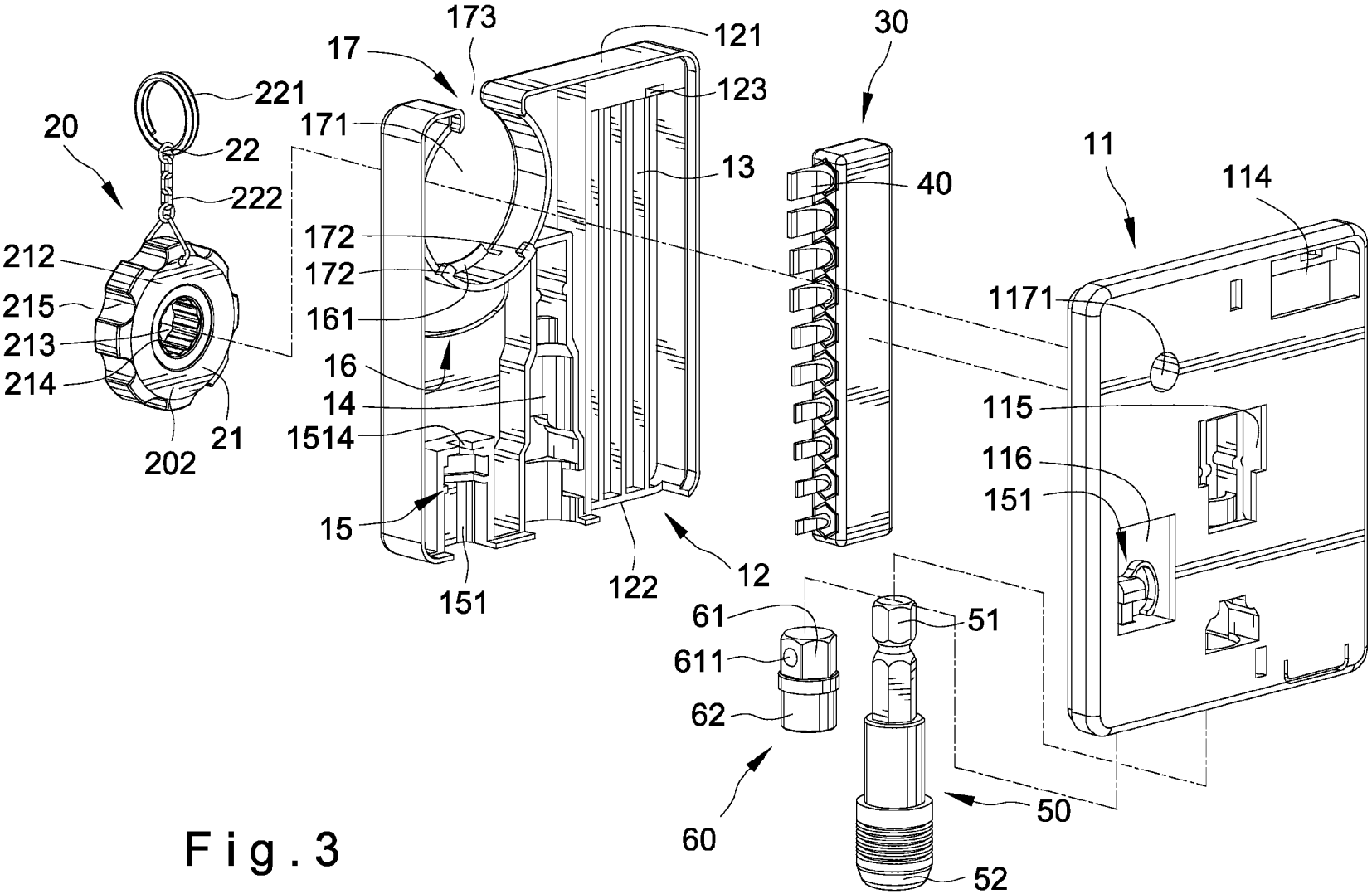
FIG. 3 is another exploded view of the tool box shown in FIG. 1.
Figure 4:
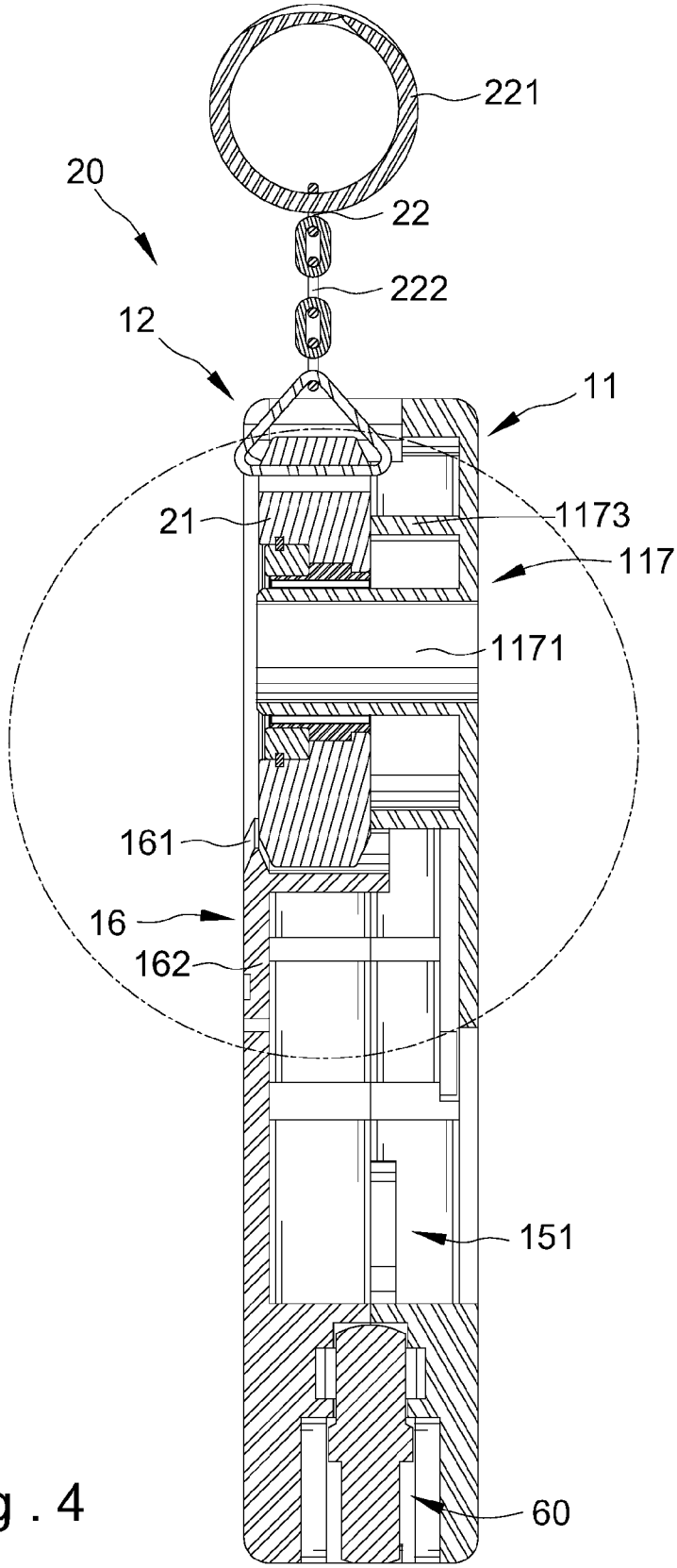
FIG. 4 is a cross-sectional view taken along 4-4 in FIG. 1.
Figure 5:
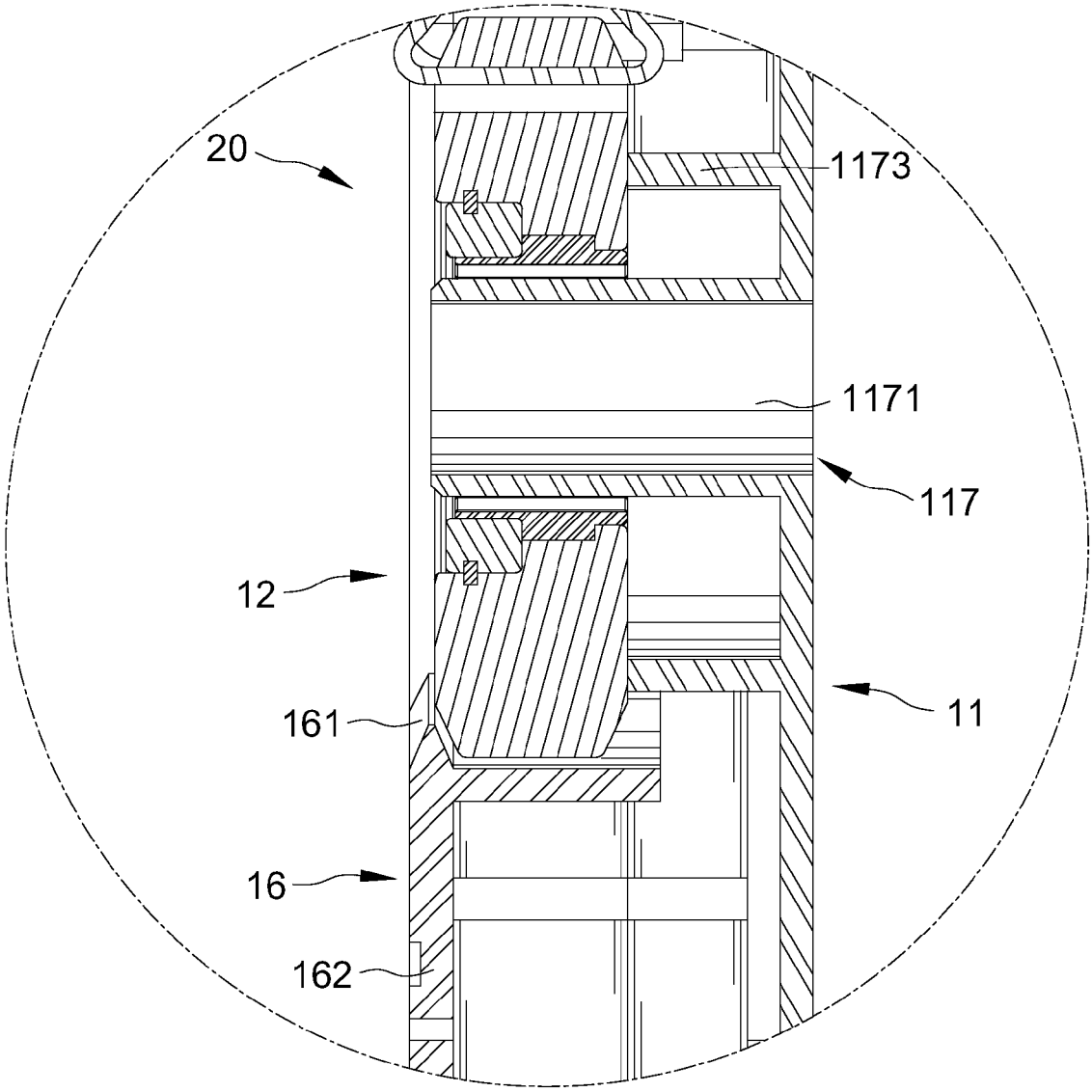
FIG. 5 is a partial, enlarged view of the tool box shown in FIG. 4.
Figure 6:
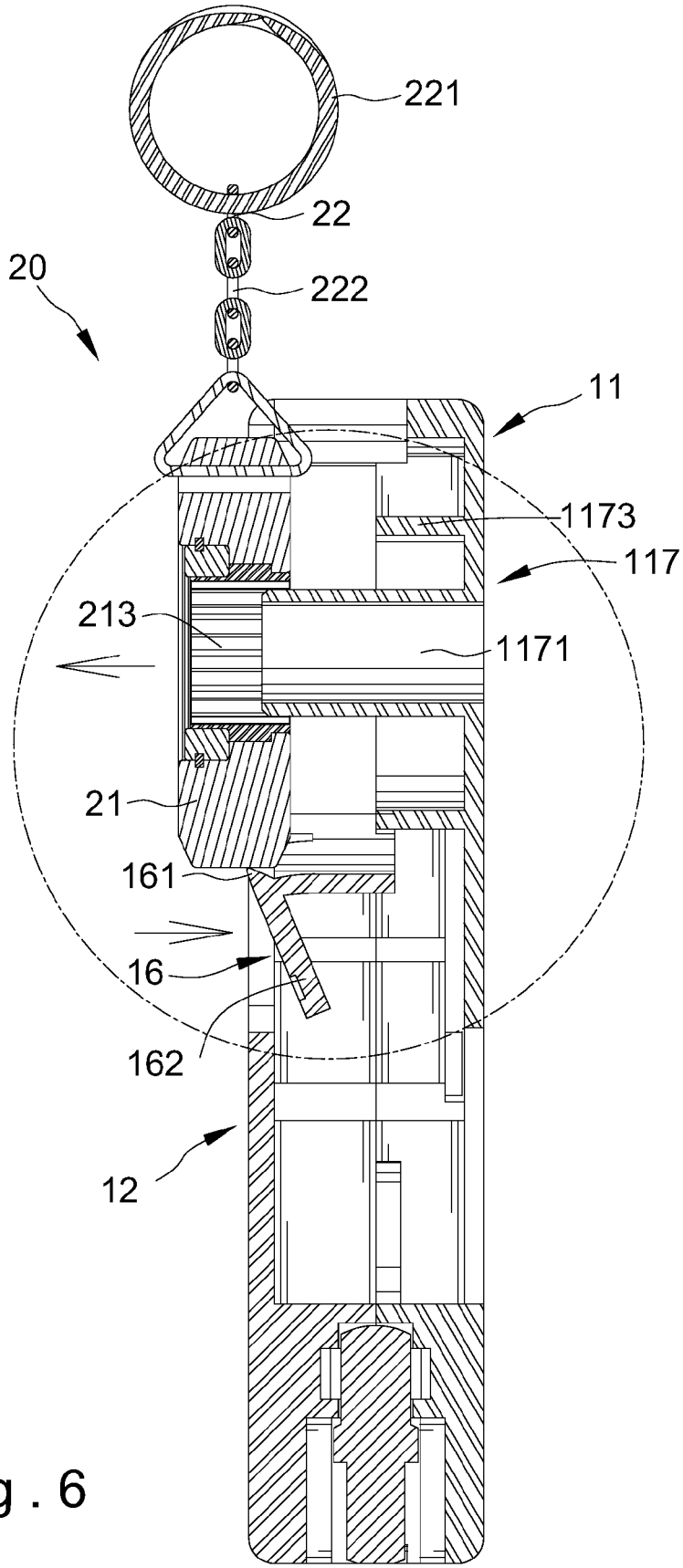
FIG. 6 is a cross-sectional view similar to FIG. 4, illustrating that a removal of the ratchet wheel unit from the fixed projection of the casing means.
Figure 7:
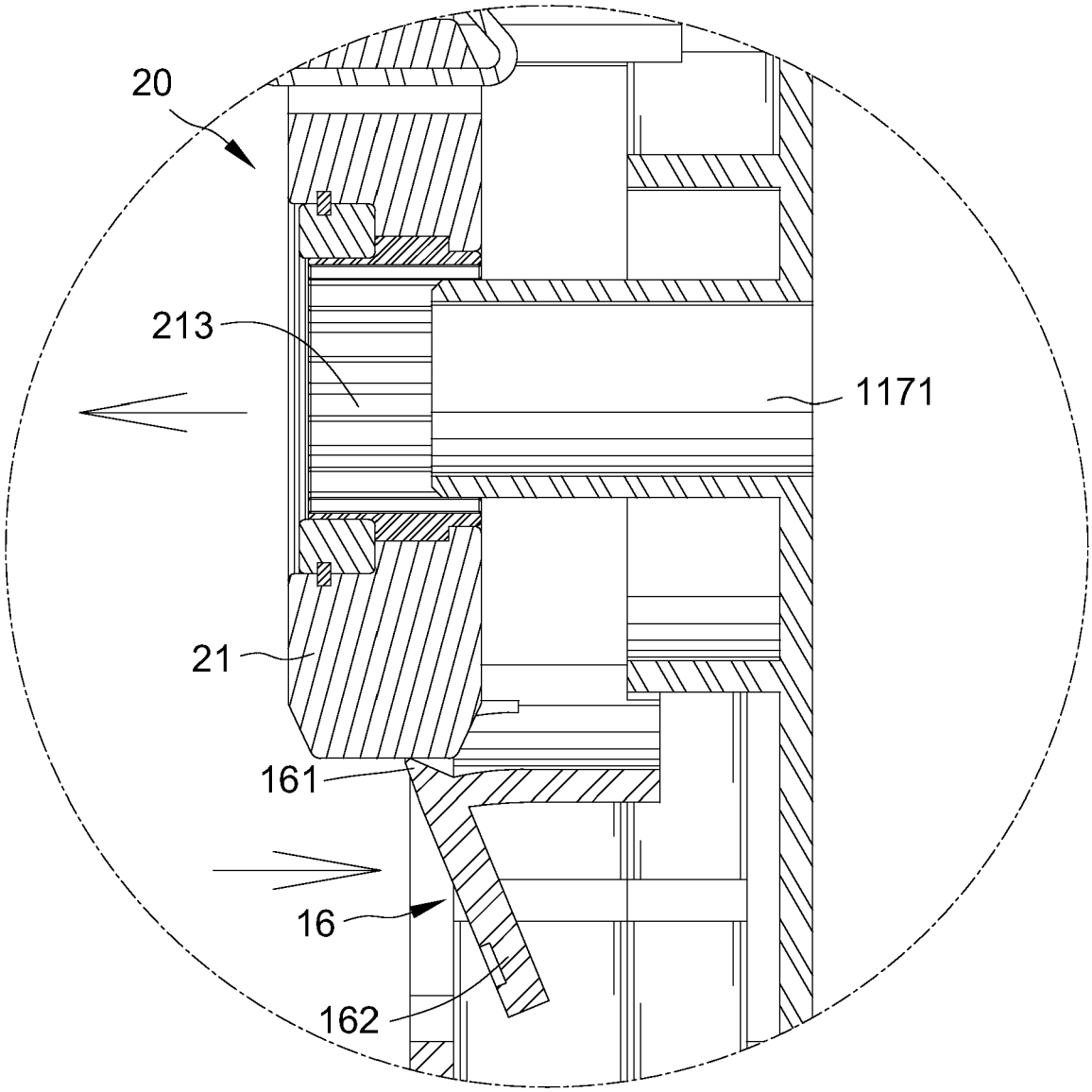
FIG. 7 is a partial, enlarged view of the tool box shown in FIG. 6.
Figure 8:
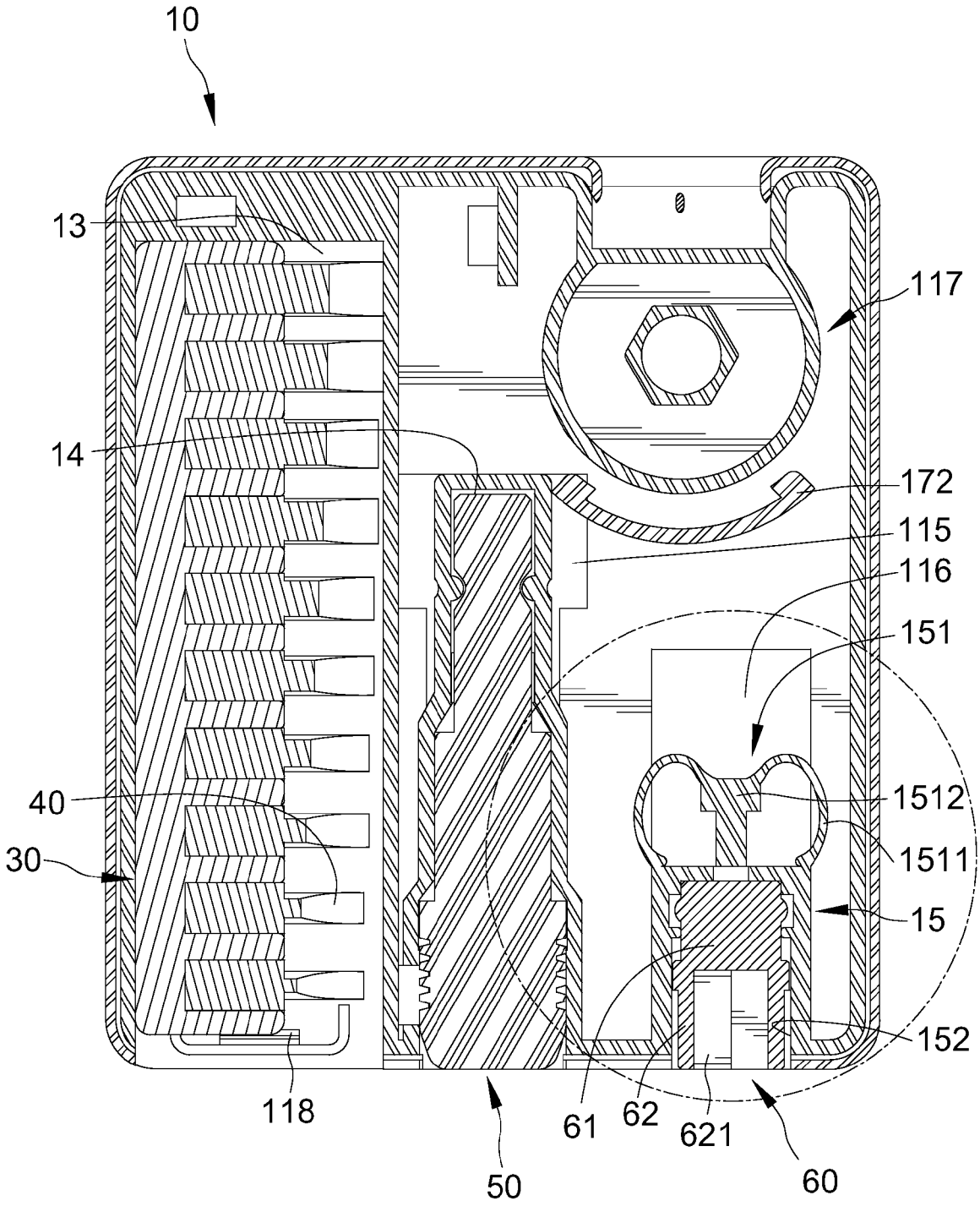
FIG. 8 is a cross-sectional view taken along 8-8 in FIG. 1.
Figure 9:
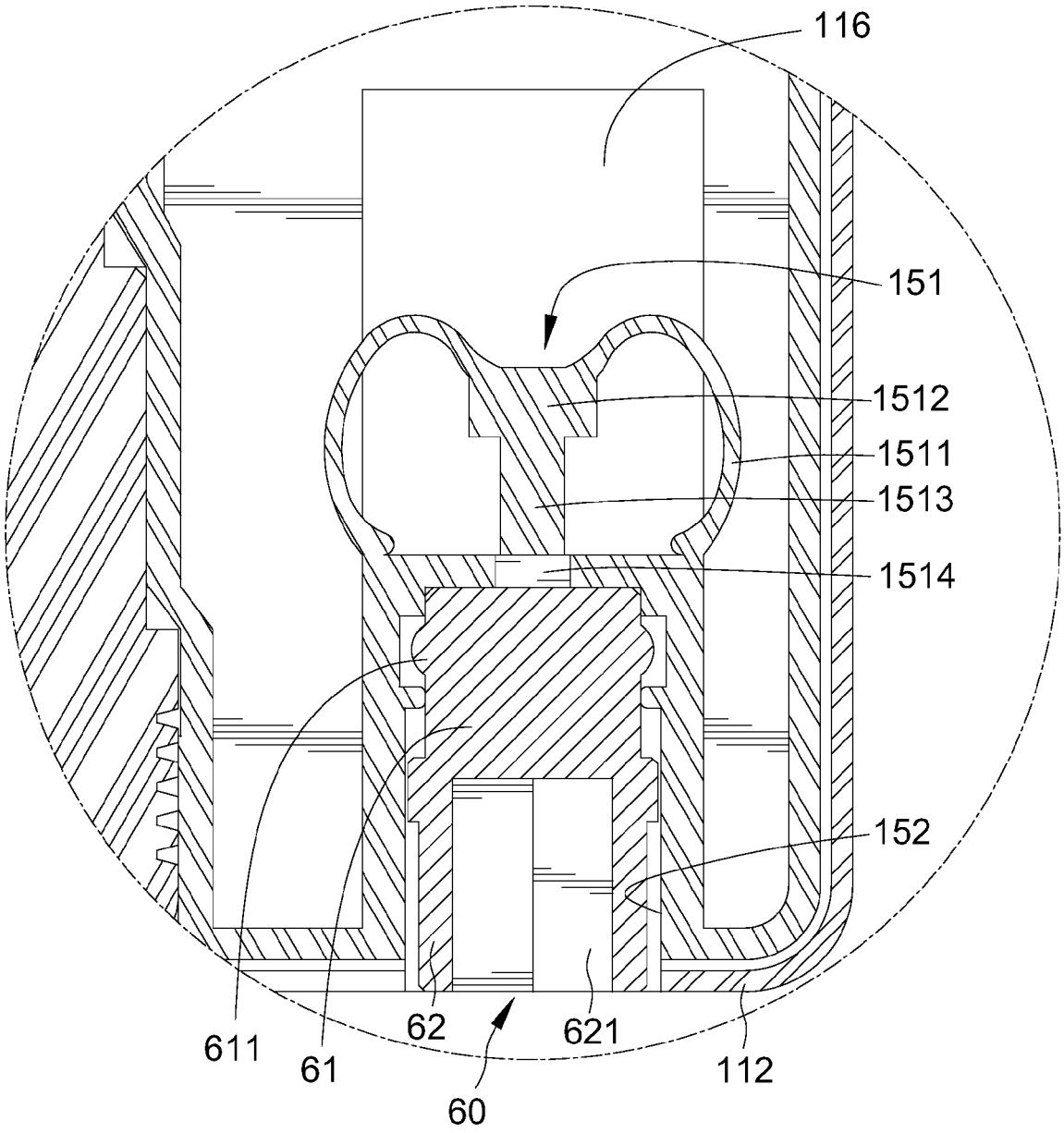
FIG. 9 is a partial, enlarged view of the tool box shown in FIG. 8.
Figure 10:
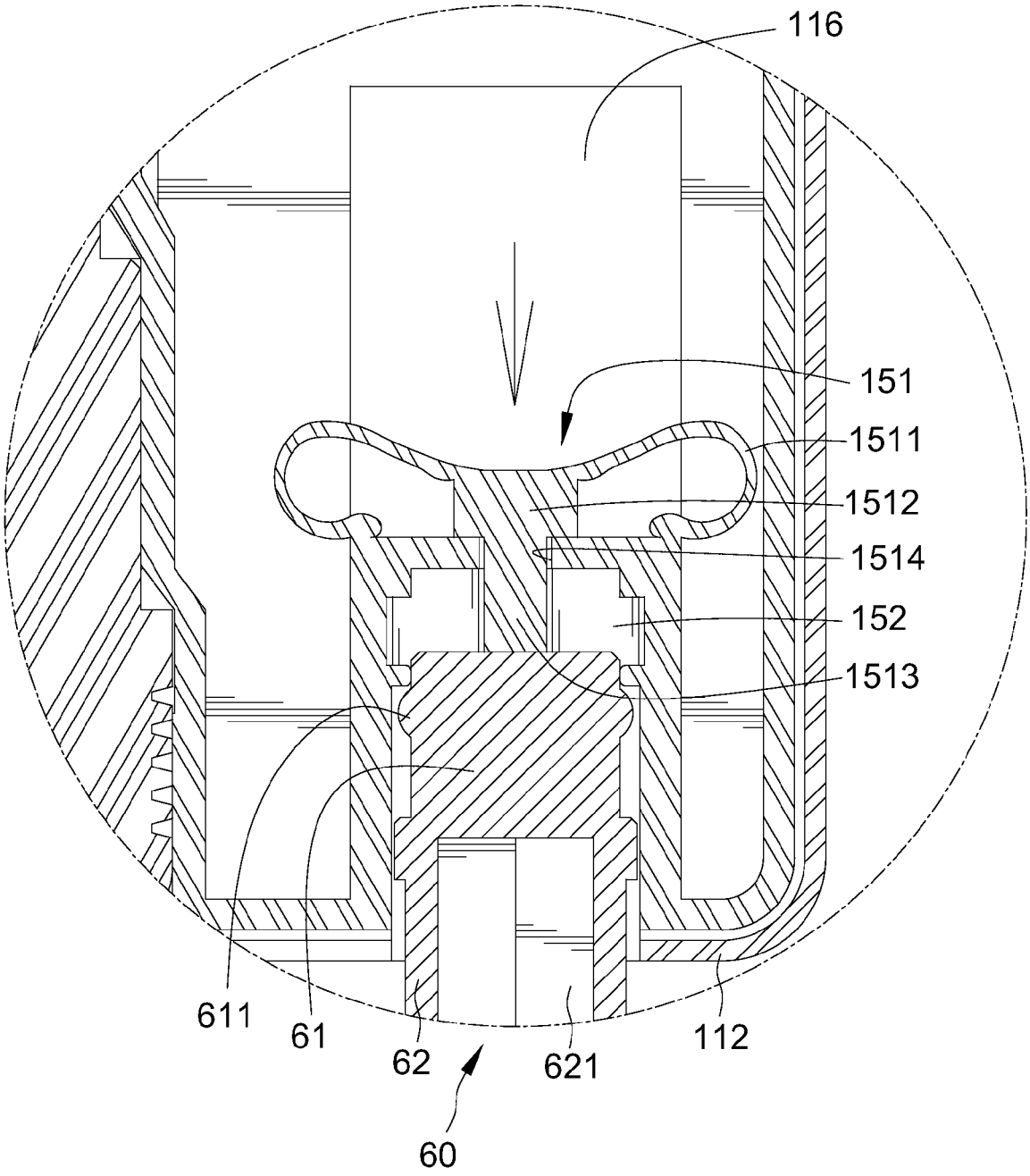
FIG. 10 is an enlarged cross-sectional view similar to FIG. 9, illustrating that a removal of the second driver adapter from the receiving portion of casing means by pressing the pressing member.

Further, the first, second and third compartments 13, 14, 15 are opened to the bottom edges 112, 122 and respectively have openings (not numbered) on the bottom of the casing means 10 so that the bits seat body 30 and the first and second driving tools 50, 60 are able to detach from the casing means 10 without taking apart the casing means 10. A hook 118 is provided on the inner wall of the first compartment 13 and proximal to the bottom edge 112 of the first casing shell 11 as to securely clamp the bits seat body 30 in the first compartment 13 (shown in FIG. 2).

A first through-hole 114 are formed on the side wall of the first casing shell 11 above the first compartment 13 so that while the bits seat body 30 is clamped in the first compartment 13, parts of the bits seat body 30 is exposed from the first through-hole 114. And while the bits seat body 30 is desired to detach from the casing means 10, user's finger can insert into the first through-hole 114 from outside of the first casing shell 11 to push the bits seat body 30 to disengage with the hook 18 and then the bits seat body 30 is able to depart from the opening of the first compartment 13.

A second through-hole 115 are formed on the side wall of the first casing shell 11 above the second compartment 14 so that while the first driving tool 50 is clamped in the second compartment 14, parts of the first driving tool 50 is exposed from the second through-hole 115. And while the first driving tool 50 is desired to detach from the casing means 10, user's finger can insert into the second through-hole 115 from outside of the first casing shell 11 to push the first driving tool 50 to disengage with the second compartment 14 and then the first driving tool 50 is able to depart from the opening of the second compartment 14.

The pressing member 151 includes an elastic rim 1511, a pressing portion 1512, a stud 1513 and an orifice 1514 formed on the top of the receiving portion 152. The elastic rim 1511 is preferably M-shaped and integrally formed with the pressing portion 1512 and the top of the receiving portion 152. The stud 1513 is coupled to the bottom of the pressing portion 1512 and corresponding to the orifice 1514. The receiving portion 152 is adapted to clamp the second driving tool 60. A third through-hole 116 are formed on the side wall of the first casing shell 11 above the pressing member 151 of the third compartment 15 so that while the second driving tool 60 is clamped in the receiving portion 152 of the third compartment 15, parts of the pressing member 151 is exposed from the second through-hole 115.

When the pressing member 151 is in an original position, the stud 1513 does not engage with the orifice 1514. When the pressing member 151 is in an actuating position, user's finger can insert into third through-hole 116 from outside of the first casing shell 11 to push the pressing portion 1512 for driving the stud 1513 to insert through the orifice 1514 as to push the second driving tool 60 to detach from the opening of the third compartment 15. And after removal of user's finger from the pressing portion 1512, the elastic rim 1511 is released and the pressing member 151 is back to the original position.

A first receptacle 117 is defined on the inner wall of the first casing shell 11 and includes a fixed projection 1171 protruding from the center thereof and first and second flanges 1172, 1173 formed as the periphery thereof. The first receptacle 117 is above the second and third compartments 14, 15. The fixed projection 1171 is in form of a hexagonal rod. The second flange 1173 is proximal to and parallel to the top edge 111 of the first casing shell 11 and preferably flat. The first flange 1172 is in form of a major arc.

A second receptacle 17 is defined at the second casing shell 12 and includes a through-hole 171 corresponding to the first flange 1172 of the first receptacle 117 and an opening 173 formed on the top edge 121 of the second casing shell 12. Two blocking studs 172 are set on the periphery of the second receptacle 17 inside of the casing means 10.

A pressing plate 16 is disposed on the outer wall of the second casing shell 12 and abuts with the periphery of the second receptacle 17 opposite to the blocking studs 172. The pressing plate 16 is in form of fan-shaped and defines a gripping edge 161 proximal to the through-hole 171 and a pressing edge 162 opposite to the gripping edge 161.

The ratchet wheel unit 20 includes a ratchet wheel member 21 having first and second sides 211, 212 and provided to be disposed at the casing means 10 and a key ring member 22 coupled to the ratchet wheel member 21. The ratchet wheel member 21 includes a through-hole 213 defined at the center thereof, a polygonal inner periphery 214 around the through-hole 213 and numbers recesses 215 provided on the outer periphery thereof. The key ring member 22 has a key ring 221 and a chain 222 coupled the key ring 221 and the ratchet wheel member 21 to each other.

When the ratchet wheel unit 20 is in a storage position, the ratchet wheel member 21 is inserted through the through-hole 171 of the second receptacle 17 and the through-hole 213 is inserted by the fixed projection 1171. A cooperation of the hexagonal fixed projection 1171 and the polygonal inner periphery 214 prevents the ratchet wheel member 21 from rotating with respect to the casing means 10. At the same time, the chain 222 of the key ring member 22 is through the opening 173 and the key ring 221 is out of the casing means 10. In the storage position, the first and second sides 211, 212 of the ratchet wheel member 21 are respectively restricted by the gripping edge 161 and the blocking studs 172 so that user can grip the key ring member 22 to carry the whole tool box 100.

When the ratchet wheel unit 20 is desired to detach from the casing means 10, user has to press the pressing edge 162 of the pressing plate 16 toward the casing means 10 first, and then, the gripping edge 161 is driven to detach from the ratchet wheel member 21. And user can grip the key ring member 22 to remove the ratchet wheel unit 20 from the casing means 10.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A tool box adapted for storing a driving tool therein, the tool box comprising:

a casing means including a compartment adapted for receiving the driving tool;

wherein the compartment further includes a pressing member and a receiving portion below the pressing member and adapted to clamp the driving tool; wherein the pressing member is movable between an original position and an actuating position; wherein while the pressing member is in the actuating position, the driving tool is driven to detach from the casing means;

wherein the tool box is adapted for storing a bits seat body and first and second driving tools therein; wherein the casing means including first, second and third compartments adapted for receiving the bits seat body and the first and second driving tools, respectively, with the pressing member and the receiving portion defined at the third compartment;

wherein the pressing member includes a pressing portion, a stud and an orifice formed on the top of the receiving portion, with the stud coupled to the bottom of the pressing portion and corresponding to the orifice; wherein when the pressing member is in the original position, the stud does not engage with the orifice; wherein when the pressing member is in the actuating position, the pressing portion is pressed for driving the stud to insert through the orifice as to push the second driving tool to detach from the receiving portion of the third compartment.

2. The tool box as claimed in claim 1 wherein the first, second and third compartments are opened to the bottom of the casing means and respectively have openings on the bottom of the casing means so that the bits seat body and the first and second driving tools are able to detach from the casing means without taking apart the casing means.

3. The tool box as claimed in claim 1 further comprising an elastic rim integrally formed with the pressing portion and the top of the receiving portion and allowing the pressing member to return to the original position from the actuating position.

4. The tool box as claimed in claim 2 further comprising first, second and third through holes formed on the side wall of the first casing shell above the first, second and third compartments, respectively, so that while the bits seat body and the first and second driving tools are clamped in the casing means, parts of the bits seat body and the first and second driving tools are exposed from the first, second and third through holes; wherein user's finger can insert into the first, second and third through holes from outside of the first casing shell to detach the bits seat body and the first and second driving tools from the openings of the casing means.

5. The tool box as claimed in claim 2 further comprising a hook provided on the inner wall of the first compartment and proximal to the bottom edge of the first casing shell as to securely clamp the bits seat body in the first compartment.

6. A tool box adapted for storing a driving tool therein, the tool box comprising:

a casing means including a compartment adapted for receiving the driving tool;

wherein the compartment further includes a pressing member and a receiving portion below the pressing member and adapted to clamp the driving tool; wherein the pressing member is movable between an original position and an actuating position; wherein while the pressing member is in the actuating position, the driving tool is driven to detach from the casing means;

wherein the tool box is adapted for storing a bits seat body and first and second driving tools therein; wherein the casing means including first, second and third compartments adapted for receiving the bits seat body and the first and second driving tools, respectively, with the pressing member and the receiving portion defined at the third compartment;

wherein the casing means consists of first and second casing shells, with the bits seat body and the first and second driving tools sandwiched by the first and second casing shells and parallel to each other;

a ratchet wheel unit set at and exposed from the casing means and movable between a storage position and a detachment position; and a first receptacle defined on the inner wall of the first casing shell and including a fixed projection protruding from the center thereof, a second receptacle defined at the second casing shell and including a through-hole corresponding to the first receptacle, wherein the ratchet wheel unit has a ratchet wheel member and a through-hole, and when the ratchet wheel unit is in the storage position, the ratchet wheel member is inserted through the through-hole of the second receptacle and the through-hole of the ratchet wheel unit is inserted by the fixed projection.

7. The tool box as claimed in claim 6 further comprising two blocking studs set on the periphery of the second receptacle inside of the casing means and a pressing plate disposed on the outer wall of the second casing shell and abutted with the periphery of the second receptacle opposite to the blocking studs, with the pressing plate 16 defining a gripping edge proximal to the through-hole; wherein when the ratchet wheel unit is in the storage position, the ratchet wheel member are respectively restricted by the gripping end and the blocking studs.

8. The tool box as claimed in claim 7 wherein the pressing plate further includes a pressing edge opposite to the gripping edge; wherein when the ratchet wheel unit is desired to detach from the casing means, user has to press the pressing edge of the pressing plate toward the casing means as to drive the gripping edge to detach from the ratchet wheel member.

9. The tool box as claimed in claim 6 wherein the ratchet wheel member further includes an polygonal inner periphery, with a cooperation of the hexagonal fixed projection and the polygonal inner periphery preventing the ratchet wheel member from rotating with respect to the casing means.

10. A tool box comprising:

a casing means which consists of first and second casing shells including a first receptacle defined on the inner wall of the first casing shell, a second receptacle defined at the second casing shell and including a through-hole corresponding to the first receptacle and a pressing plate disposed on the outer wall of the second casing shell and abutted with the periphery of the second receptacle; and a ratchet wheel unit, which is set at and exposed from the casing means, including a ratchet wheel member and moveable between storage and detachment positions by operating the pressing plate;

wherein when the ratchet wheel unit is in the storage position, the ratchet wheel member is inserted through the through-hole of the second receptacle and fixed to the first receptacle.

11. The tool box as claimed in claim 10 wherein the tool box is adapted for storing a bits seat body and first and second driving tools therein; wherein the casing means including first, second and third compartments adapted for receiving the bit seat body and the first and second driving tools, respectively, with the pressing member and the receiving portion defined at the third compartment.

12. The tool box as claimed in claim 11 wherein the third compartment further includes a pressing member and a receiving portion below the pressing member and adapted to clamp the second driving tool; wherein the pressing member is movable between an original position and an actuating position; wherein while the pressing member is in the actuating position, the second driving tool is driven to detach from the casing means.

13. The tool box as claimed in claim 12 wherein the pressing member includes a pressing portion, a stud and an orifice formed on the top of the receiving portion, with the stud coupled to the bottom of the pressing portion and corresponding to the orifice; wherein when the pressing member is in the original position, the stud does not engage with the orifice; wherein when the pressing member is in the actuating position, the pressing portion is pressed for driving the stud to insert through the orifice as to push the second driving tool to detach from the receiving portion of the third compartment.

14. The tool box as claimed in claim 12 further comprising first, second and third through holes formed on the side wall of the first casing shell above the first, second and third compartments, respectively, so that while the bits seat body and the first and second driving tools are clamped in the casing means, parts of the bits seat body and the first and second driving tools are exposed from the first, second and third through holes; wherein user's finger can insert into the first, second and third through holes from outside of the first casing shell to detach the bits seat body and the first and second driving tools from the openings of the casing means.

15. The tool box as claimed in claim 13 further comprising a hook provided on the inner wall of the first compartment and proximal to the bottom edge of the first casing shell as to securely clamp the bits seat body in the first compartment.

16. The tool box as claimed in claim 12 wherein the first receptacle includes a fixed projection protruding from the center thereof and the second receptacle includes a through-hole corresponding to the first receptacle; wherein when the ratchet wheel unit is in the storage position, the ratchet wheel member is inserted through the through-hole of the second receptacle and the through-hole of the ratchet wheel unit is inserted by the fixed projection.

17. The tool box as claimed in claim 16 further comprising two blocking studs set on the periphery of the second receptacle inside of the casing means, with the pressing plate defining a gripping edge proximal to the through-hole and abutted with the periphery of the second receptacle opposite to the blocking studs; wherein when the ratchet wheel unit is in the storage position, the ratchet wheel member are respectively restricted by the gripping end and the blocking studs.

18. The tool box as claimed in claim 17 wherein the pressing plate further includes a pressing edge opposite to the gripping edge; wherein when the ratchet wheel unit is desired to detach from the casing means, user has to press the pressing edge of the pressing plate toward the casing means as to drive the gripping edge to detach from the ratchet wheel member.

* * * * *